US010807390B2

(12) United States Patent
Harris et al.

(10) Patent No.: US 10,807,390 B2
(45) Date of Patent: Oct. 20, 2020

(54) PIVOT MECHANISM FOR A PRINTER AND A PRINTER WITH A PIVOTING PRINTER HOUSING

(71) Applicant: TransAct Technologies Incorporated, Hamden, CT (US)

(72) Inventors: Bruce Harris, Freeville, NY (US); David Weeks, Willseyville, NY (US); Richard A. Monroe, Syracuse, NY (US)

(73) Assignee: TransAct Technologies Incorporated, Hamden, CT (US)

( * ) Notice: Subject to any disclaimer, the term of this patent is extended or adjusted under 35 U.S.C. 154(b) by 188 days.

(21) Appl. No.: 16/163,632

(22) Filed: Oct. 18, 2018

(65) Prior Publication Data

US 2019/0135000 A1 May 9, 2019

Related U.S. Application Data

(63) Continuation-in-part of application No. 15/796,981, filed on Oct. 30, 2017, now Pat. No. 10,611,588.

(51) Int. Cl.

| | |
|---|---|
| ***B41J 15/02*** | (2006.01) |
| ***B65H 16/06*** | (2006.01) |
| ***B41J 15/04*** | (2006.01) |
| ***B65H 19/12*** | (2006.01) |

(Continued)

(52) U.S. Cl.

CPC ..... *B41J 15/02* (2013.01); *B41J 15/042* (2013.01); *B65H 16/06* (2013.01); *B65H 19/126* (2013.01); *B65H 2301/41342* (2013.01); *B65H 2301/413223* (2013.01); *B65H 2402/5152* (2013.01); *B65H 2403/46* (2013.01);

(Continued)

(58) Field of Classification Search

CPC . B41J 15/02; B41J 15/04; B41J 15/042; B41J 15/16; B41J 15/22; B41J 11/001; B41J 29/02; B41J 29/04; B65H 19/126; B65H 16/06; B65H 2403/46; B65H 2701/1936; B65H 2801/12;

(Continued)

(56) References Cited

U.S. PATENT DOCUMENTS 2,059,198 A * 11/1936 Everest ..... B41J 15/02 235/58 CF
3,346,872 A * 10/1967 Teichner ..... B41J 15/04 346/145

(Continued)

*Primary Examiner* — William A. Rivera
(74) *Attorney, Agent, or Firm* — Lipsitz & McAllister, LLC

(57) ABSTRACT

A pivot mechanism for a printer is provided, the pivot mechanism comprising a pivot base and two oppositely disposed side walls extending perpendicular to the pivot base. An arched slot may be provided in each side wall. Each slot may have at least two notches, each notch defining different positions of the pivot mechanism. Two lever arms may be provided, each of the two lever arms comprising a first end and a second end, with a connecting rod connecting the first ends of the lever arms together. A locking pin may be disposed on the second end of each of the lever arms. Each of the locking pins may extend into a corresponding one of the slots and engage with a corresponding notch. A pivot rod extends through the lever arms and into or through the side walls. The printer housing is adapted to pivot on the pivot rod.

42 Claims, 17 Drawing Sheets

(52) U.S. Cl.
CPC .. *B65H 2511/12* (2013.01); *B65H 2701/1936* (2013.01); *B65H 2801/12* (2013.01)

(58) Field of Classification Search
CPC .. B65H 2402/5152; B65H 2301/41342; B65H 2301/413223; B65H 2511/12
See application file for complete search history.

(56) References Cited

U.S. PATENT DOCUMENTS

| | | | | |
|---|---|---|---|---|
| 5,230,576 | A * | 7/1993 | Sone | B41J 15/042 400/649 |
| 6,302,604 | B1 | 10/2001 | Bryant et al. | |
| 6,431,492 | B1 | 8/2002 | Chillscyzn | |
| 6,503,008 | B2 | 1/2003 | Zevin et al. | |
| 6,749,353 | B1 * | 6/2004 | Favre | B41J 15/042 400/613 |
| 7,004,462 | B2 | 2/2006 | Bryer | |
| 8,500,351 | B2 * | 8/2013 | Colonel | B41J 11/0025 400/693 |
| 2002/0121566 | A1 | 9/2002 | Fiutak et al. | |
| 2005/0180796 | A1 * | 8/2005 | Blanchard, Jr. | B41J 15/02 400/613 |
| 2005/0199763 | A1 | 9/2005 | Myers et al. | |
| 2008/0179444 | A1 * | 7/2008 | Takeuchi | B41J 15/042 242/564.1 |
| 2011/0200375 | A1 | 8/2011 | Kokawa et al. | |
| 2012/0155946 | A1 * | 6/2012 | Colonel | B41J 15/046 400/691 |
| 2020/0147984 | A1 * | 5/2020 | Weeks | B41J 15/042 |

* cited by examiner

PIVOT MECHANISM FOR A PRINTER AND A PRINTER WITH A PIVOTING PRINTER HOUSING

This application is a continuation-in-part of commonly-owned, co-pending U.S. patent application Ser. No. 15/796,981 filed on Oct. 30, 2017, which is incorporated herein by reference in its entirety and for all purposes.

BACKGROUND OF THE INVENTION

The present invention relates to the field of printers. More specifically, the present invention relates to a pivot mechanism for a printer, as well as a printer with a pivoting printer housing.

Printers that print from paper rolls are widely used in various locations, including at the point of sale in retail establishments, in kiosks such as ATM and ticket machines, in lottery machines, and anywhere the printing of labels is required, such as in the food preparation area of fast food restaurants or the like. Such printers include label printers, ticket printers, receipt printers, and the like (collectively referred to herein as "label and receipt printers").

Such printers may be mounted in different locations, orientations, and/or heights. For example, such printers may be mounted on a table, on a high counter, or on a wall.

It would be advantageous to provide a pivot mechanism for a printer that enables adjustability of an angle of the printer housing with respect to a mounting base. It would be further advantageous to provide a number of predetermined angles to enable different viewing angles of the printer display, to facilitate access to paper loading and removal, and/or to enable access to the printer internals.

The apparatus of the present invention provides the foregoing and other advantages.

SUMMARY OF THE INVENTION

The present invention relates a pivot mechanism for a printer, as well as a printer with a pivoting printer housing.

In an example embodiment of a pivot mechanism for a printer in accordance with the present invention, the pivot mechanism may comprise a pivot base and two oppositely disposed side walls extending perpendicular to the pivot base. An arched slot may be provided in each of the side walls. Each slot may have at least two notches, each of the at least two notches defining different positions of the pivot mechanism. Two lever arms may be provided, each of the two lever arms comprising a first end and a second end, with a connecting rod connecting the first ends of the lever arms together. A locking pin may be disposed on the second end of each of the lever arms. Each of the locking pins may extend into a corresponding one of the slots and engage with a corresponding one of the at least two notches. A pivot rod extends through the lever arms and into or through the side walls. The printer housing of a printer is adapted to pivot on the pivot rod.

The at least two notches locate the printer housing at predetermined angles in order to provide for at least one of adjustability of a viewing angle of a screen located in the printer housing, paper loading and removal, and opening of a printer housing cover for access to an interior of the printer housing.

The lever arms may be positioned inside of the side walls and each of the lever arms may be positioned adjacent a corresponding one of the side walls. The pivot rod may extend through elongated slots in the lever arms.

A pull handle may be provided, which is connected to the connecting rod for disengaging the locking pins from the corresponding notches, enabling a pivoting motion about the pivot rod.

The pivot rod may extend through elongated slots in the lever arms. The slots may be adapted to permit the lever arms freedom of movement relative to the pivot rod to allow the pull handle to move the lever arms in order to disengage the locking pins from the corresponding notches while guiding the pivoting motion.

The lever arms may extend into an interior of the printer housing through slots in the printer housing. The connecting rod may be disposed in the interior of the printer housing. The pull handle may be slidably disposed in a front of the printer housing with a first portion of the pull handle extending into the interior of the printer housing through an opening in the printer housing and a second portion of the pull handle extending over the opening on an outside of the printer housing, with the first portion of the pull handle being connected to the connecting rod.

The pivot mechanism may further comprise a biasing mechanism for biasing the locking pins into the corresponding notches upon a release of the pull handle. The biasing mechanism may comprise at least one biasing spring connected between the connecting rod and the printer housing.

Guide ribs may be provided on an underside of the second portion of the pull handle, which guide ribs slidably engage against the outside of the printer housing.

The connecting rod may pass through the pull handle, exerting a first biasing force on the pull handle in a direction towards the interior of the printer housing. Two straps may be connected to the interior of the printer housing and pass over the first portion of the pull handle. The two straps may exert a second biasing force on the pull handle in a direction away from the interior of the printer housing while permitting freedom of movement of the pull handle in a direction transverse to the first and second biasing forces.

The arched slot may be arranged off center in relation to a line passing through an axis of the pivot rod perpendicular to the pivot base. The line does not pass through any of the at least two notches.

The at least two notches may be substantially U-shaped notches. A radius at a bottom of each of the at least two notches may be smaller than a radius of the locking pin. Sides of each of the at least two notches may diverge from one another at a top open end of the notch.

A portion of each of the two lever arms may slidably engage with at least one guide rib disposed on an interior of the printer housing.

The at least two notches may comprise a first notch, a second notch, a third notch, and a fourth notch. For example, the first, second, and third notches may provide different viewing angles for the printer housing in a table mounting position. The fourth notch may be spaced apart from the first, second, and third notches and may provide a viewing angle for the printer housing in a wall mounting position.

At least one of the at least two notches defines a table mounting position for the printer housing. At least one other of the at least two notches defines a wall mounting position for the printer housing.

The pivot base may be adapted to be mounted to an underside of a printer base for the printer. In such an embodiment, the lever arms may extend through slots in the printer base. The pivot rod may further extend into or through side walls of the printer base and side walls of the printer housing.

The present invention also encompasses a printer with a pivoting printer housing. In an example embodiment of a printer with a pivoting printer housing in accordance with the present invention, the printer may comprise a printer housing, a printer base, and a pivot mechanism which pivotally connects the printer housing to the printer base. The pivot mechanism may comprise a pivot base connected to the printer base and two oppositely disposed side walls extending perpendicular to the pivot base. An arched slot may be provided in each of the side walls. Each slot may have at least two notches, each of the at least two notches defining different positions of the pivot mechanism. Two lever arms may be provided, each of the two lever arms comprising a first end and a second end. A connecting rod connects the first ends of the lever arms together. A locking pin may be disposed on the second end of each of the lever arms. Each of the locking pins may extend into a corresponding one of the slots and engage with a corresponding one of the at least two notches. A pivot rod may extend through the lever arms and into or through the side walls of the pivot base. The printer housing is adapted to pivot on the pivot rod.

The pivot mechanism of the printer may include any additional features of the example embodiments of the pivot mechanism discussed above.

BRIEF DESCRIPTION OF THE DRAWINGS

The present invention will hereinafter be described in conjunction with the appended drawing figures, wherein like reference numerals denote like elements, and.

DETAILED DESCRIPTION

The ensuing detailed description provides exemplary embodiments only, and is not intended to limit the scope, applicability, or configuration of the invention. Rather, the ensuing detailed description of the exemplary embodiments will provide those skilled in the art with an enabling description for implementing an embodiment of the invention. It should be understood that various changes may be made in the function and arrangement of elements without departing from the spirit and scope of the invention as set forth in the appended claims.

Figure 1:
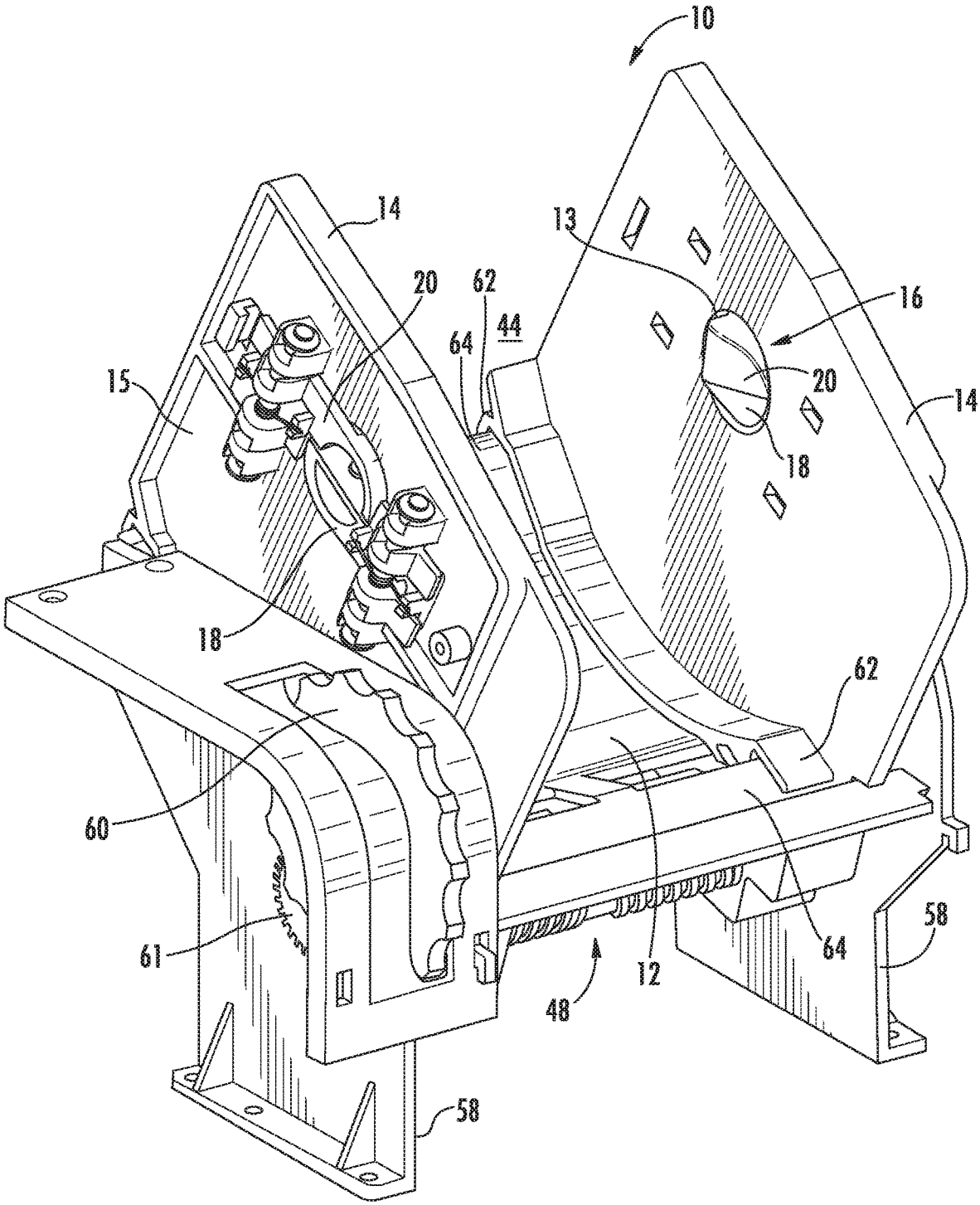
FIG. 1 shows an example embodiment of a paper bucket with spindle assemblies in accordance with the present invention.

An example embodiment of a paper bucket 10 for a printer in accordance with the present invention is shown in FIG. 1. The paper bucket 10 may comprise a curved base portion 12 for accepting paper rolls of varying widths, two oppositely disposed side walls 14 movably mounted to the curved base portion 12, and a two-part spring-loaded spindle assembly 16 extending through openings 13 in each of the side walls 14 and adapted to support a paper roll therebetween.

Figure 2:
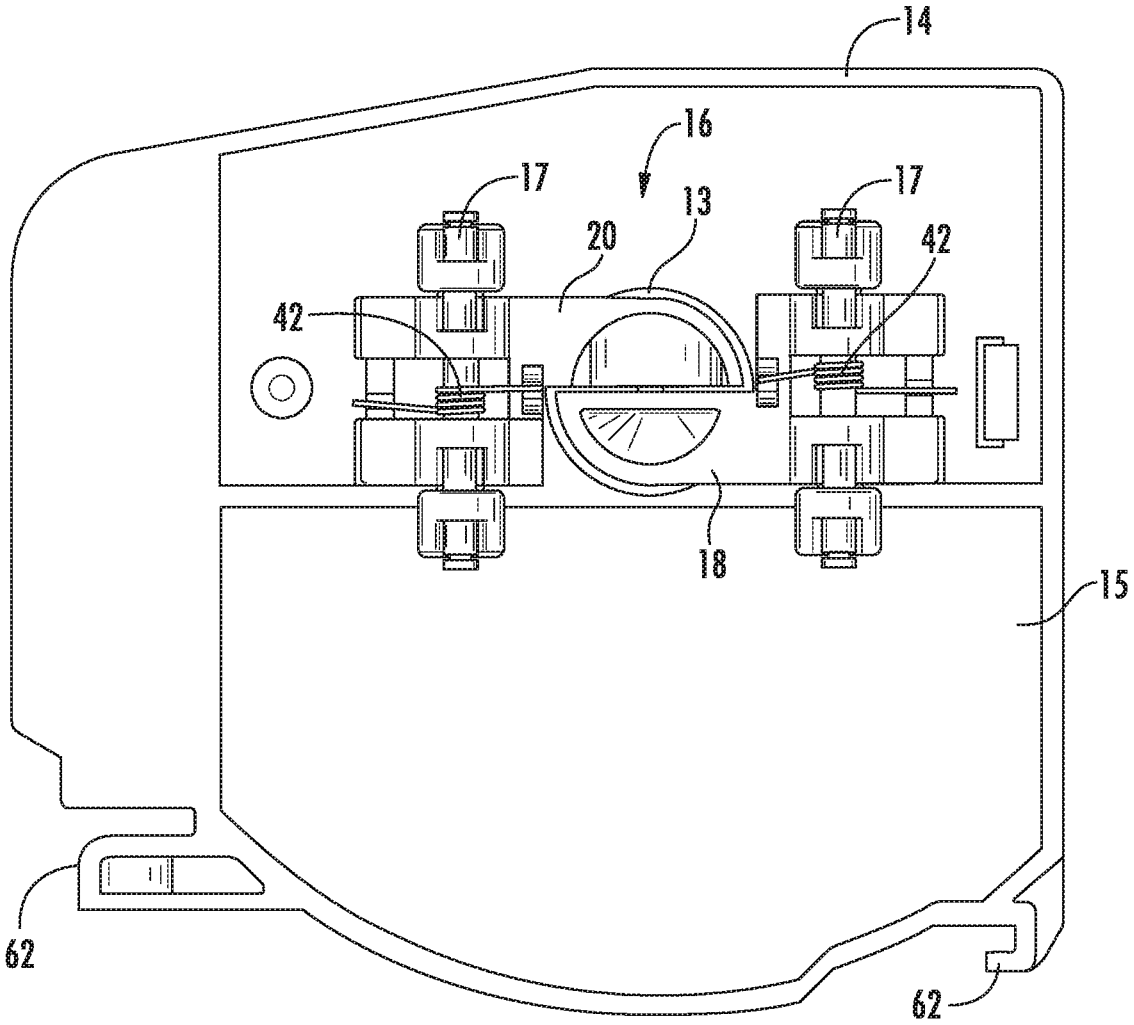
FIG. 2 shows a spindle assembly of FIG. 1 in a side wall of the paper bucket viewed from an outside of the paper bucket.
Figure 3:
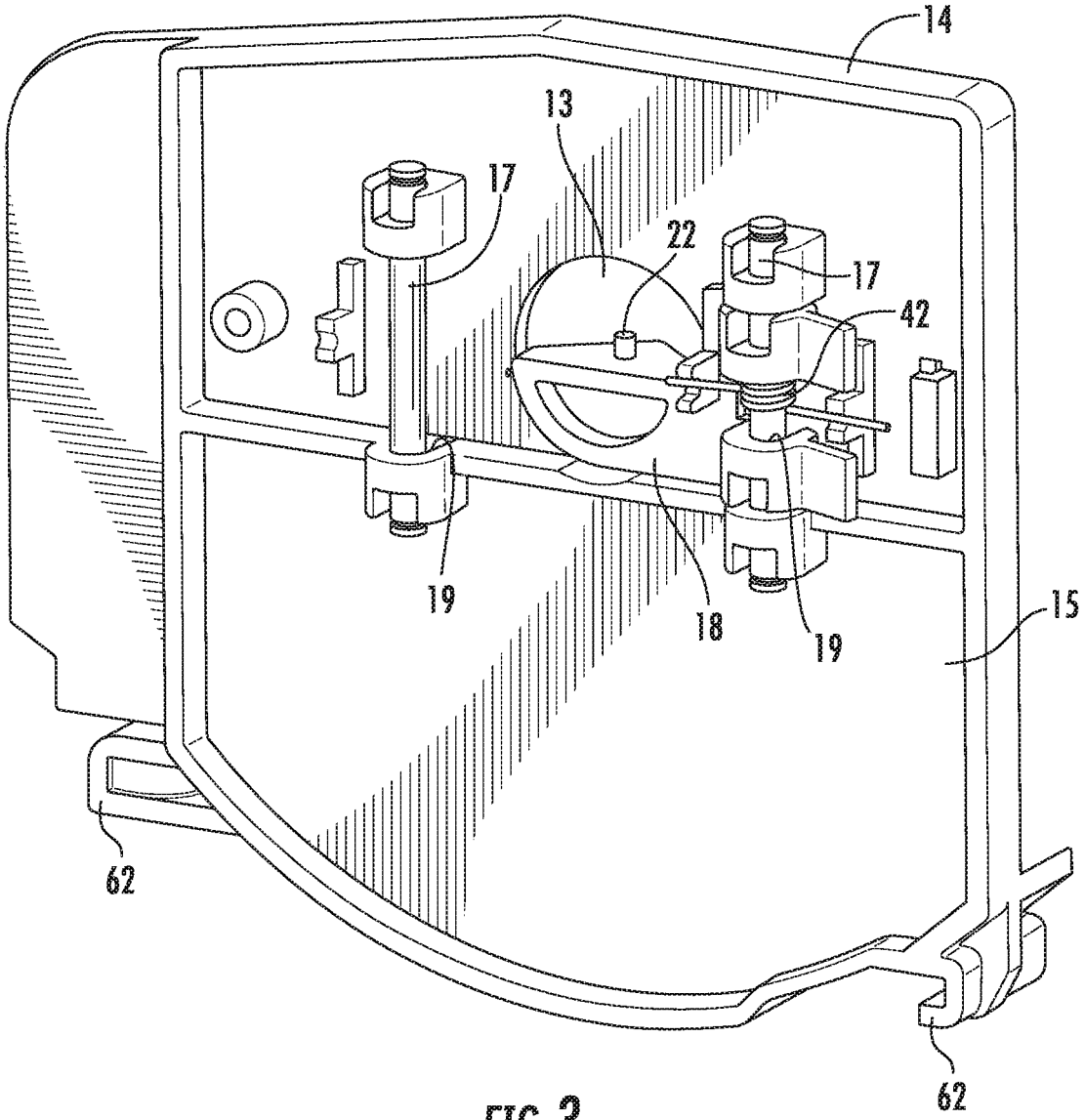
FIG. 3 shows a first portion of the spindle assembly of FIG. 2.
Figure 4:
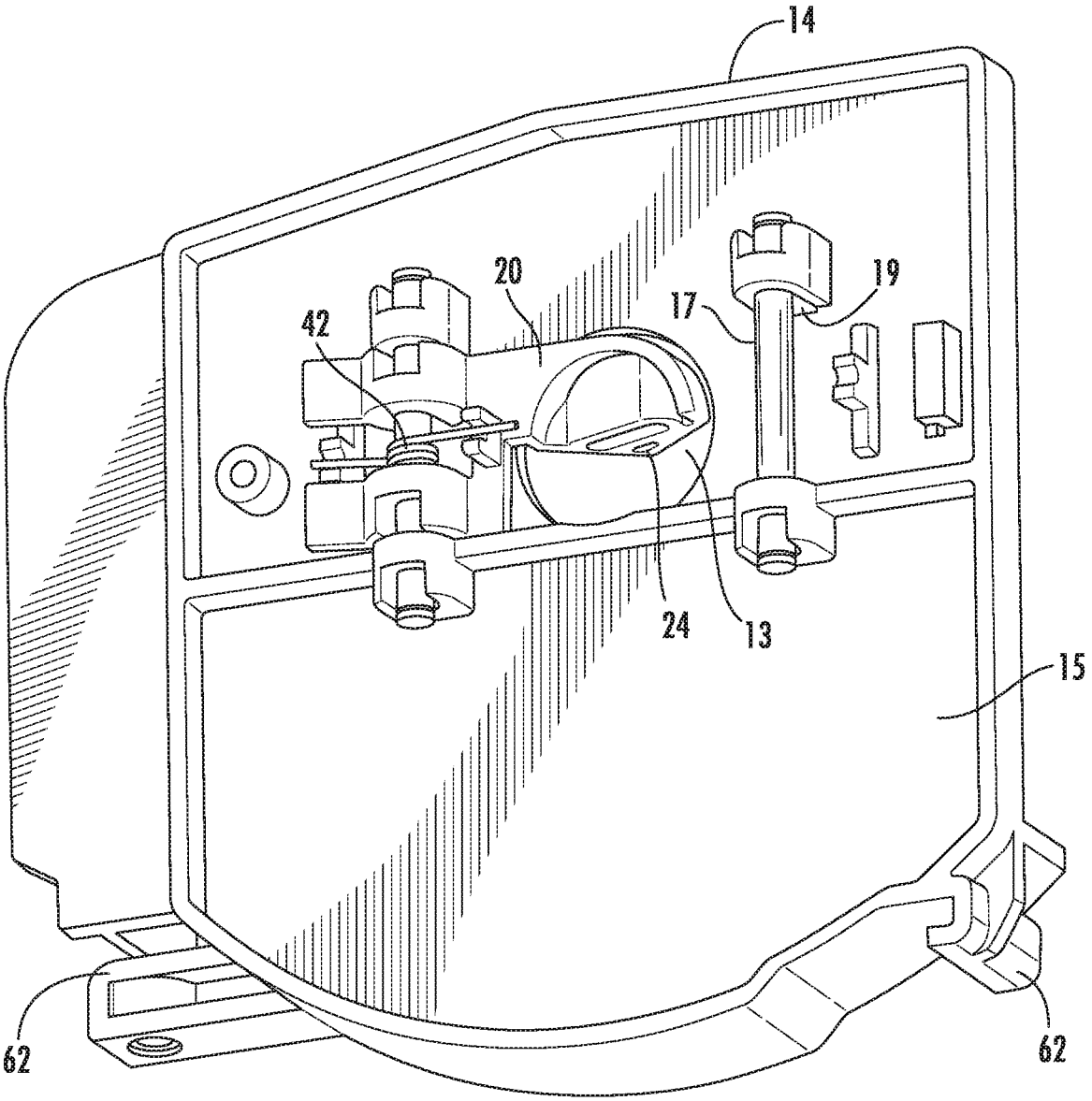
FIG. 4 shows a second portion of the spindle assembly of FIG. 2 from a perspective view.

As shown in FIGS. 2-4, each spindle assembly 16 may comprise a first spring loaded spindle part 18 and a second spring loaded spindle part 20 movably connected to one another. FIG. 2 shows both spindle parts 18 and 20. For clarity, FIG. 3 shows only the first spindle part 18 and FIG. 4 shows only the second spindle part 20.

The first and second spindle parts 18 and 20 of each of the spindle assemblies may be movably connected to one another via a pin and hole arrangement. For example, the first spindle part 18 may be provided with a pin 22 that extends into a hole 24 in the second spindle part 20. In one example embodiment, the first spindle part 18 may be arranged below the second spindle part 20.

As shown in FIG. 4, each of the spindle parts 18 and 20 may be pivotally connected to an outer side 15 of the corresponding side wall 14, for example via a pin 17 and slot 19 arrangement. The pin 17 and slot 19 arrangements for each of the corresponding spindle parts 18 and 20 may be disposed on opposite sides of the opening 13 in the side wall 14.

Figure 5:
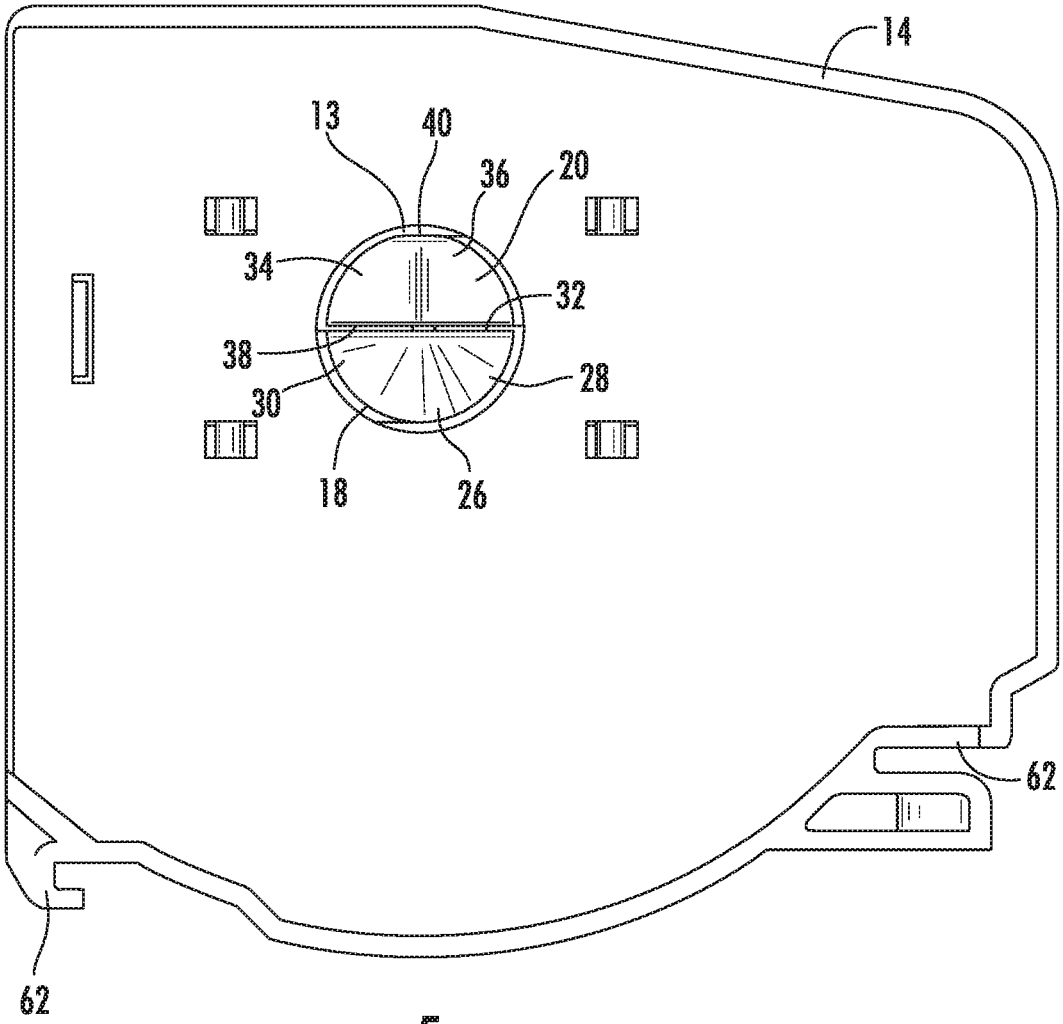
FIG. 5 shows a spindle assembly of FIG. 1 in a side wall of the paper bucket viewed from an inside of the paper bucket.

As shown in FIG. 5, the first spindle part 18 may have chamfered bottom 26 and side surfaces 28, 30, and a flat upper surface 32. The second spindle part 20 may have chamfered side surfaces 34, 36, a flat bottom surface 38, and a flat upper surface 40.

The pin 22 may extend from one of the upper surface 32 of the first spindle part 18 or the bottom surface 38 of the second spindle part 20. The hole 24 may be arranged in the other of the upper surface 32 of the first spindle part 18 or the bottom surface 38 of the second spindle part 20.

The first spindle part 18 and the second spindle part 20 of each of the spindle assemblies 16 may be biased by a biasing force into a position extending through the opening 13 and into an interior 44 of the paper bucket 10. In such an embodiment, asserting a force against the biasing force on either one of the first spindle part 18 or the second spindle part 20 results in movement of both the first spindle part 18 and the second spindle part 20 in a direction away from an interior 44 of the paper bucket (as described in detail in connection with FIG. 6 below). The biasing force for each of the spindle parts may be provided by a corresponding spring mechanism 42. The spring mechanism 42 may comprise an arrangement of one or more springs, a resilient member, or the like.

Due to the shape of each of the spindle parts 18 and 20 as shown in FIG. 5 and described above, the spindle assemblies 16 as a whole may have chamfered sides and a chamfered bottom, and a flat top. The chamfered sides enable the paper roll to be installed from the front or back of the paper bucket, as pushing the paper roll into the paper bucket from the front or the back engages the chamfered sides of the spindle assembly 16 and causes the spindle parts 18 and 20 to move out of the paper bucket against the biasing force of the spring mechanism 42. The chamfered sides and bottom of the spindle assemblies 16 enable the paper roll to be removed from either the front, the back, or the top of the paper bucket, as pulling the paper roll out of the paper bucket in any direction causes the paper roll to engage one of the chamfered sides or the chamfered bottom of the spindle assemblies 16, causing each of the first and second spindle parts 18 and 20 to move out of the paper bucket against the biasing force of the spring mechanism 42. The flat top surface 40 of the spindle assemblies 16 prevents the paper roll from effecting any movement of the first and second spindle parts 18 and 20, and serves to suspend the paper roll above the curved base portion 12 of the paper bucket 10.

Figure 6:
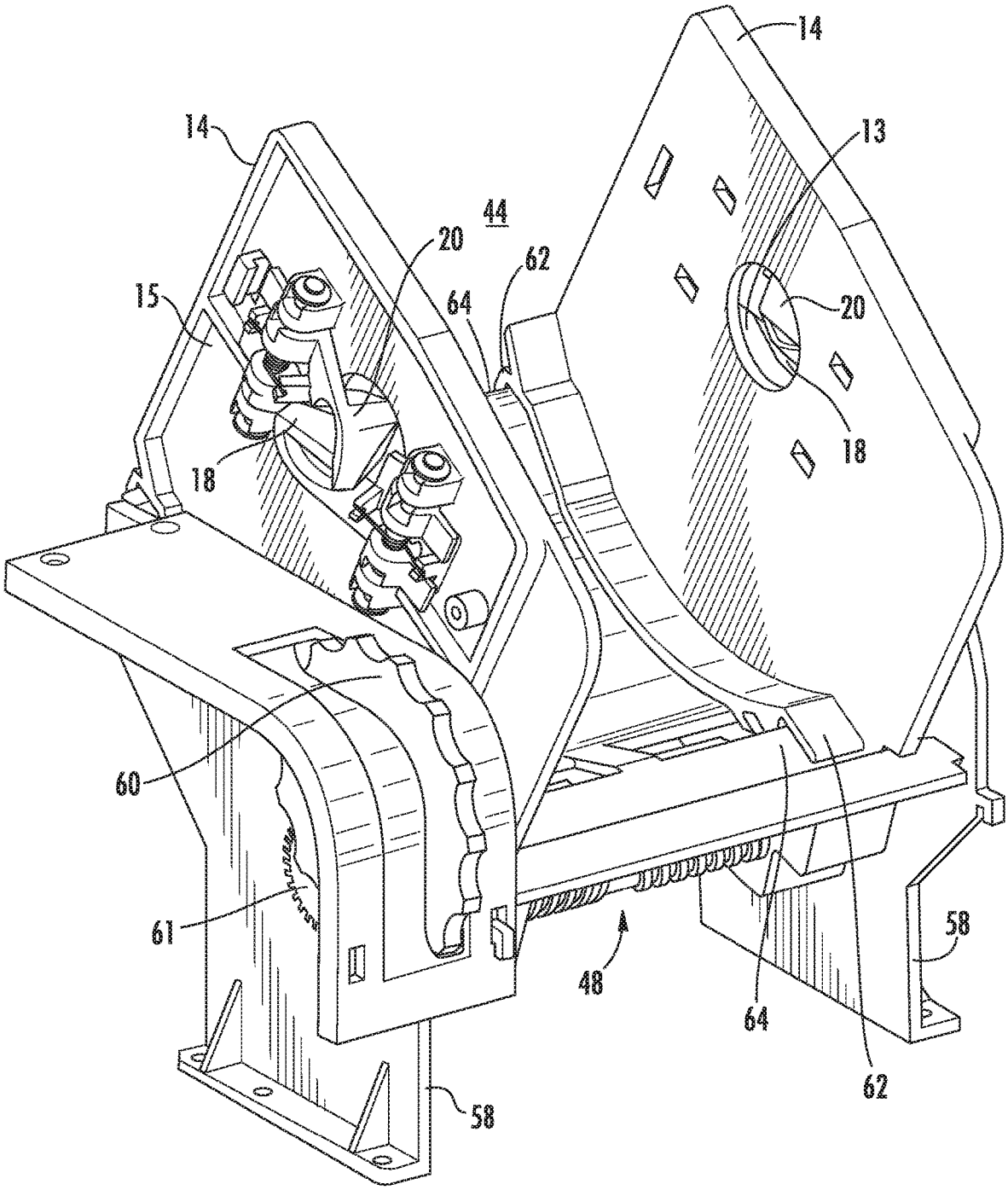
FIG. 6 shows the paper bucket of FIG. 1 with the spindle assemblies in a pushed-out position.

In particular, forces exerted by the outside of the paper roll (on insertion) or by the inside of the paper roll (on removal) against any of the chamfered surfaces 26, 28, 30, 34, or 36 of either of the spindle parts 18 or 20 results in movement of the both of the spindle parts 18 and 20 in a direction out of the opening 13, as a result of the connection between the spindle parts 18 and 20 provided by the pin 22 and hole 24. FIG. 6 shows the paper bucket 10 with the spindle assemblies 16 in an opened or pushed out position, for example when engaged by a paper roll pushing on the spindle assembly 16 against the biasing force of the spring mechanism 42. As shown in FIG. 6, the spindle parts 18 and 20 move together with a scissoring type action due to the pin 22 and hole 24 connection and the mounting of the spindle parts 18 and 20 on respective opposite sides of the opening 13.

The shape of the spindle assemblies 16 allows for the loading of the paper roll without the need to adjust the side walls 14 in or out when replacing a paper roll of equal widths. In addition, such a configuration can accommodate large paper rolls without excess drag. For example, the spindle assemblies 16 of the present invention enable a print mechanism to work with larger paper rolls. For example, with the present invention, a print mechanism that was able to advance at the most a 2.2 inch wide paper roll with a 4 inch diameter is now capable of advancing a three inch wide paper roll with a five inch diameter without any increase in drag.

Figure 7:
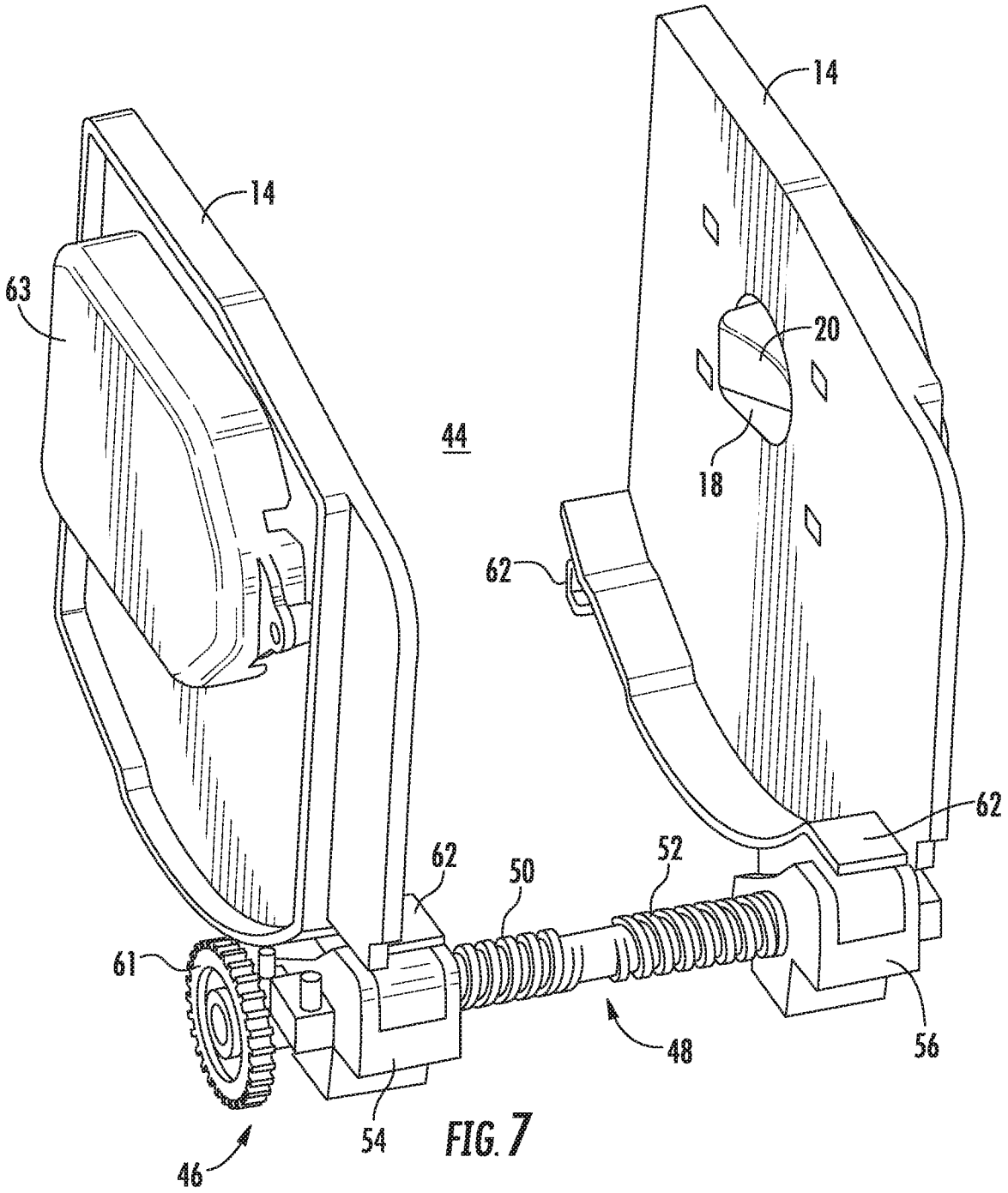
FIG. 7 shows an example embodiment of a drive mechanism for the side walls of a paper bucket in accordance with the present invention.

As shown in FIG. 7, the paper bucket may further comprise a drive mechanism 46 for moving the side walls 14 in or out to accommodate paper rolls of varying widths. The drive mechanism 46 may comprise a worm gear 48 with opposing externally threaded sections 50, 52. Each of the side walls 14 may be mounted on a corresponding one of the threaded sections 50, 52 via one of corresponding internally threaded sections of the side walls 14 or corresponding internally threaded mounting blocks 54, 56 connected to the side walls 14. The worm gear 48 may be mounted to side supports 58 of the paper bucket 10, as shown in FIG. 1. FIG. 7 also shows an optional cover 63 that may be provided over the outer part of the spindle assemblies 16.

The drive mechanism 46 may also comprise a thumb wheel 60 (FIG. 1) and a gear mechanism 61 (FIG. 7), which may be connected to the worm gear 48 for adjusting positioning of the side walls 14 to accommodate varying paper widths.

One of the threaded sections 50, 52 of the worm gear 48 may comprise left-handed threads while the other of the threaded sections may comprise right-handed threads. Thus, moving the thumb wheel 60 in one direction simultaneously moves both side walls 14 towards one another, and moving the thumb wheel 60 in the opposite direction simultaneously moves both side walls 14 away from one another. In this manner, the width of the paper bucket can be easily adjusted to accommodate paper rolls of varying widths. For example, paper rolls of any increment in size between approximately one to three inches wide (or more) can be accommodated easily in accordance with an example embodiment of the present invention. Those skilled in the art will appreciate that different ranges in paper roll size may be easily accommodated by providing differently sized paper buckets and/or a longer or shorter worm gear.

Each of the side walls 14 may be guided for mutual displacement along the base portion 12 by inter-engaging sections 62 of the side walls 14 and sections 64 of the curved base portion 12. For example, the sections 62 of the side walls may be in the form of slots and the sections 64 of the curved base portion may be in the form of edge sections that engage in the slots.

Figure 8:
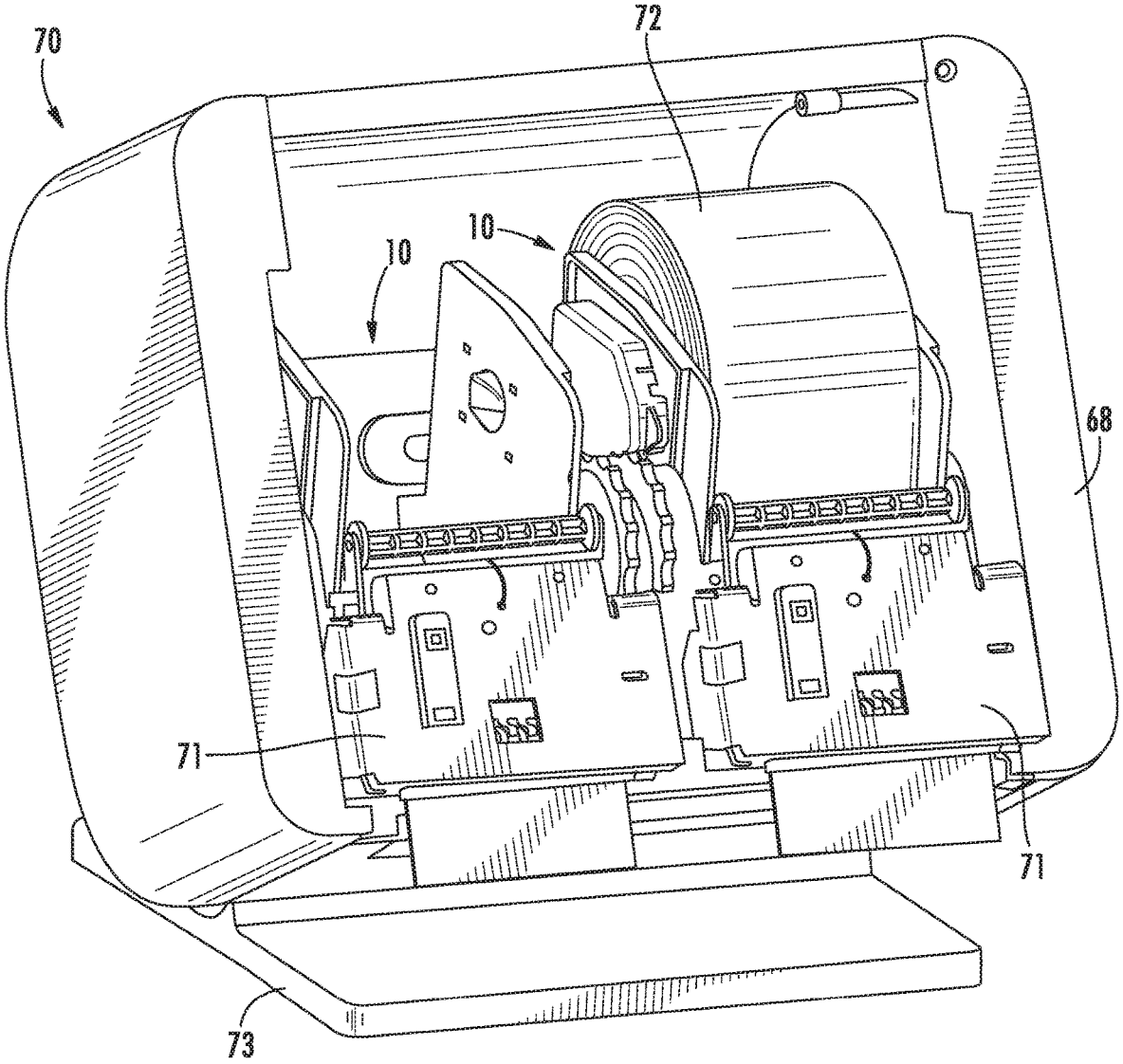
FIG. 8 shows an example embodiment of a printer with two paper buckets in accordance with the present invention.

As shown in FIG. 8, the paper bucket 10 may be mounted in a printer housing 68 of a printer 70. FIG. 8 shows an example embodiment of a printer 70 having two paper buckets 10 and two print mechanisms 71 (e.g., such as those used in the food services industry). However, the present invention is not limited to such an embodiment and those skilled in the art will appreciate that the printer 70 may comprise only a single print mechanism 71 with a single paper bucket 10. FIG. 8 shows the paper roll 72 positioned in one of the paper buckets 10.

Figure 9:
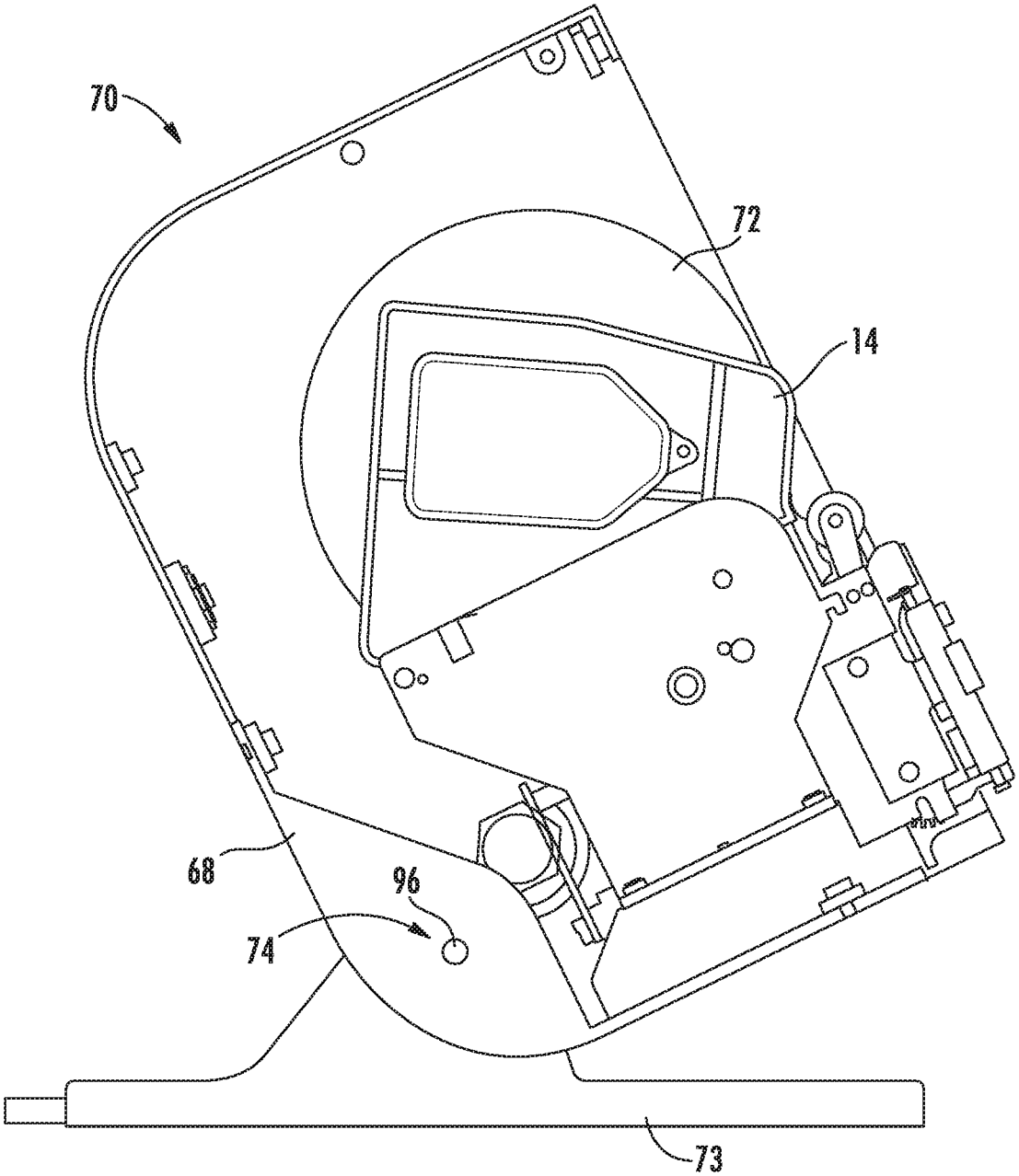
FIG. 9 shows an example embodiment of a horizontal mounting arrangement of a printer in accordance with the present invention.
Figure 10:
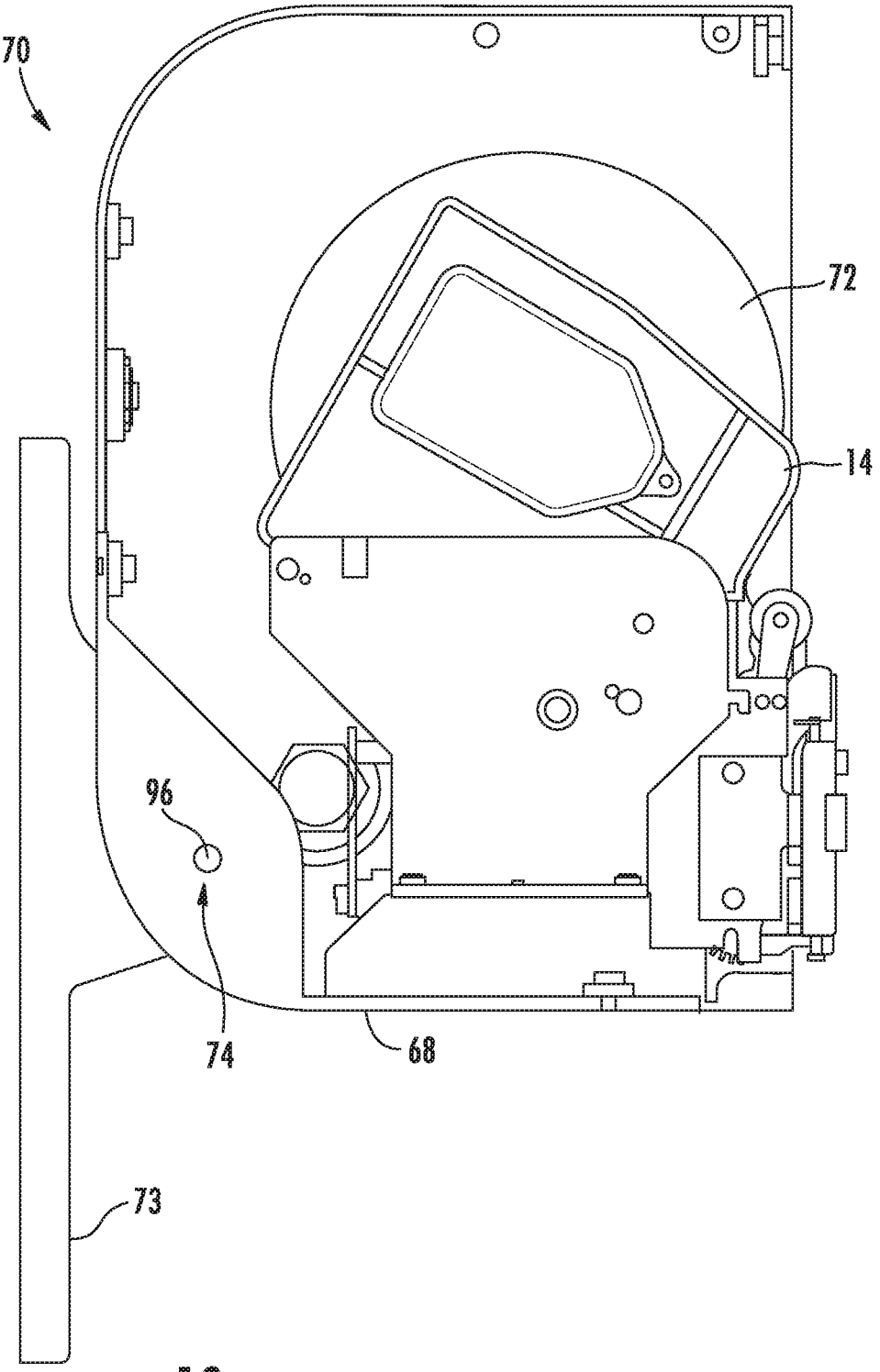
FIG. 10 shows an example embodiment of a vertical mounting arrangement of a printer in accordance with the present invention.

The printer housing 68 may be pivotally mounted on a base 73 to provide at least one of a vertical or horizontal mounting arrangement. FIG. 9 shows a horizontal mounting arrangement of the printer housing 68 and base 73, to enable, for example, table mounting of the printer 70. FIG. 10 shows a vertical arrangement of the printer housing 68 and base 73, to enable, for example, wall mounting of the printer 70. The printer housing 68 and the base 73 may be connected by a pivot mechanism 74. The pivot mechanism 74 may comprise a pin/rod and hole arrangement, a ball and socket arrangement, a hinge arrangement, or the like. A locking mechanism may be provided for locking the printer housing 68 in a particular position with respect to the base 73. The pivot mechanism 74 may also enable mounting of the printer 70 on an inclined surface.

Figure 11:
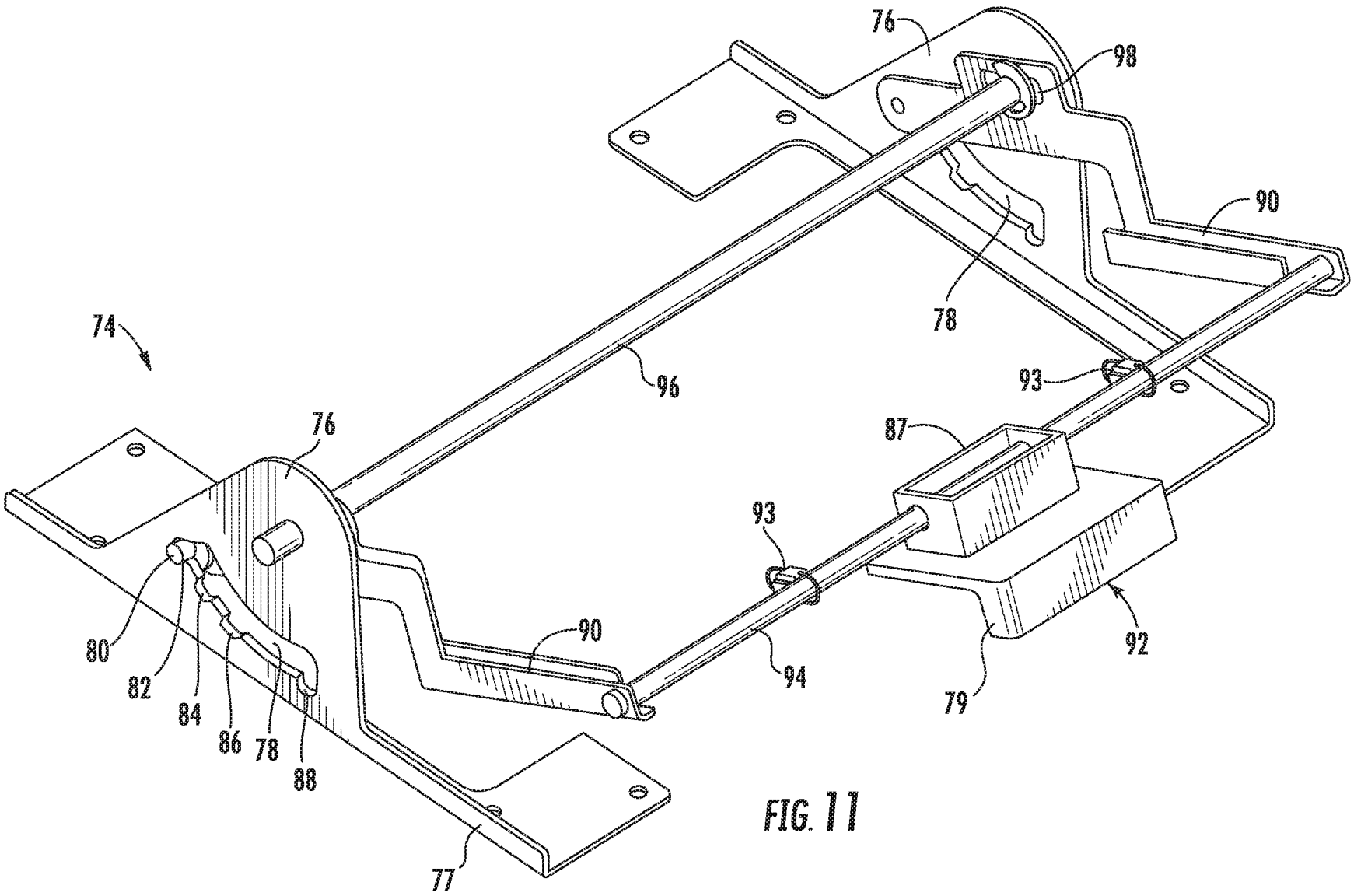
FIGS. 11-17 show an example embodiment of a pivot mechanism for a printer housing in accordance with the present invention.
Figure 12:
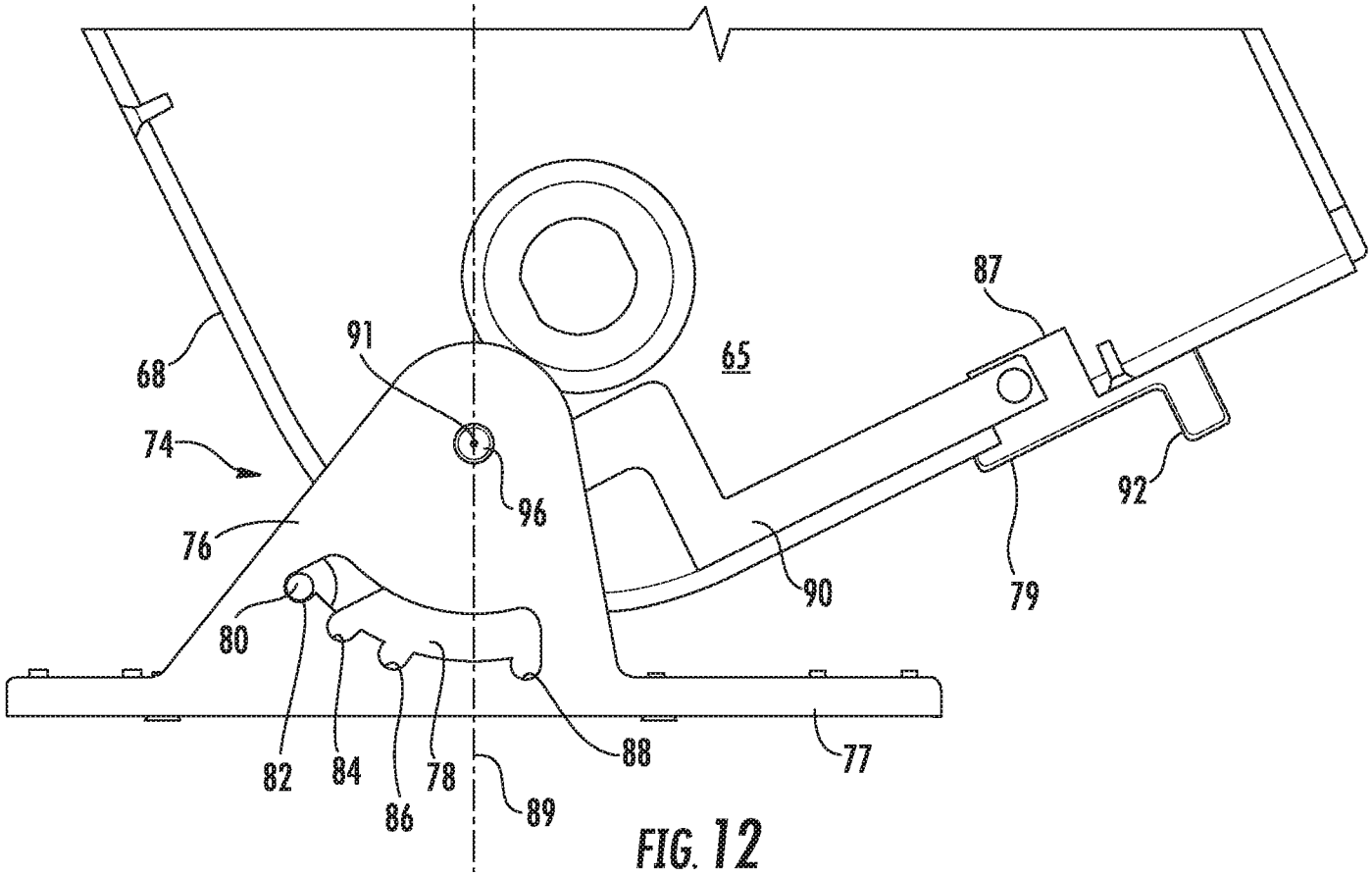
Figure 13:
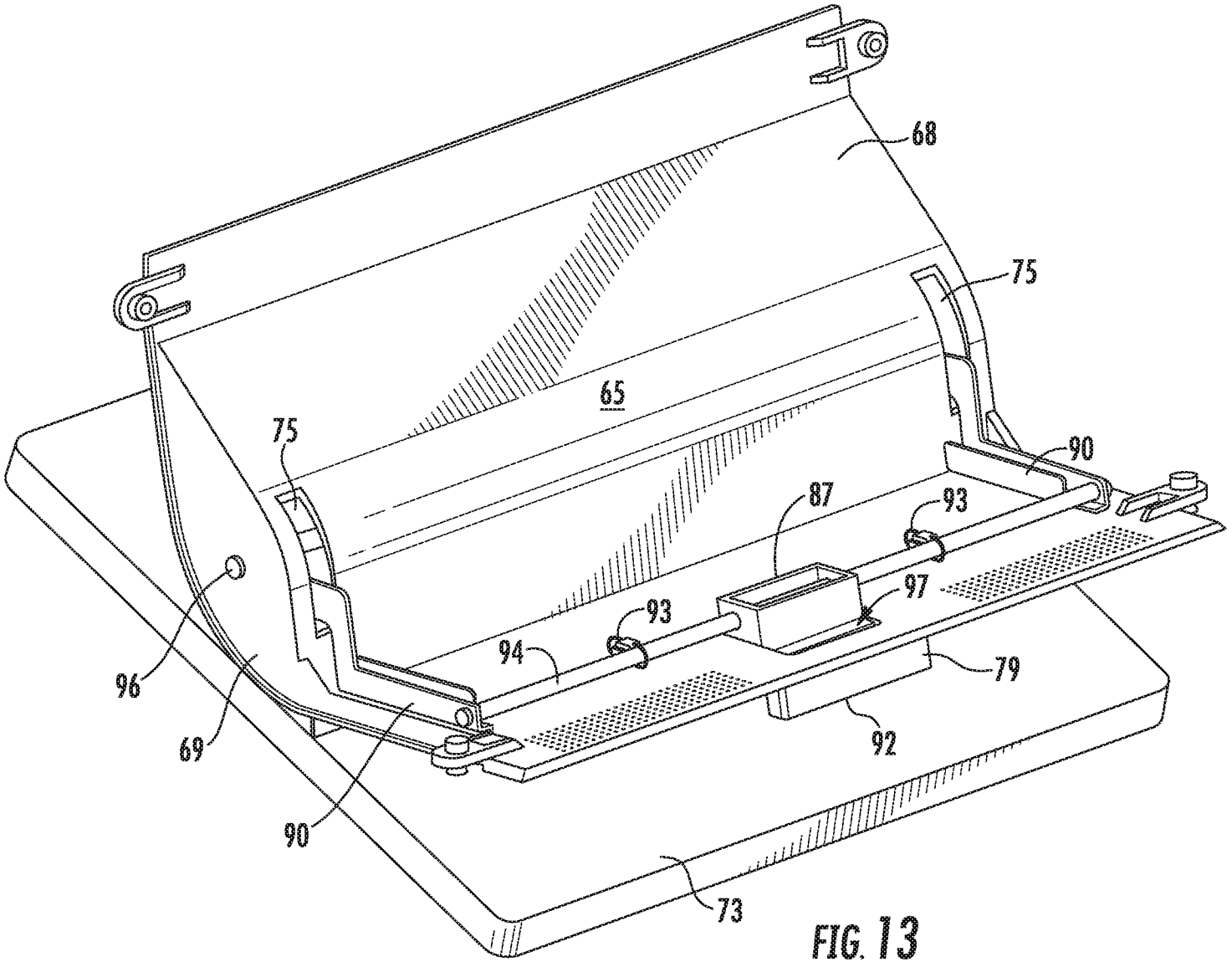

FIG. 11 shows an example embodiment of a pivot mechanism 74 for a printer housing 68. FIG. 12 shows a side cutaway view of the pivot mechanism 74 installed in a printer housing 68. FIG. 13 shows a view of the pivot mechanism 74 within the housing 68.

In the example embodiment shown in FIGS. 11-13, the pivot mechanism 74 may comprise a pivot base 77 having oppositely disposed side wall extensions 76 extending perpendicular to the pivot base 77. The pivot base 77 may be mounted to an underside of the printer base 73 (which may be curved to accommodate the side wall extensions 76 as shown in FIG. 13). Each side wall extension 76 may have an arched slot 78. Each arched slot 78 may be provided with at least two notches for locating a locking pin 80. The notches provide different positions for locating the printer housing 68 at different predetermined angles with respect to the printer base 73, in order to provide for at least one of adjustability of a viewing angle of a screen located in the printer housing 68, paper loading and removal, and opening of a printer housing cover for access to an interior of the printer housing 68. FIGS. 11 and 12 show, as an example, four notches in the slots 78. Notches 82, 84, and 86 are arranged in slot 78 to provide different viewing angles for the printer housing 68 in the table mounting position as shown in FIG. 9. A fourth notch 88, spaced apart from the other three notches 82, 84, 86, may be provided for a wall mounting arrangement (as shown in FIG. 10). Those skilled in the art will appreciate that additional notches may be provided for adjusting the printer housing angle in either the vertical or horizontal mounting positions.

As shown in FIG. 12, the arched slot 78 is arranged off center in relation to a line 89 which passes through an axis 91 of the pivot rod 96 perpendicular to the pivot base 77. The line 89 does not pass through any of the notches 82, 84, 86, and 88. Such an arrangement always ensures that the pivot mechanism never comes to rest in an unconstrained condition (as would be the case where the slot and a notch would be centered under the axis 91 of the pivot rod 96). Such an arrangement also ensures that an interference exists between the locking pin 80 and a corresponding notch, reducing any slop or backlash in the system during operation of a touch screen of the printer housing 68.

Figure 16:
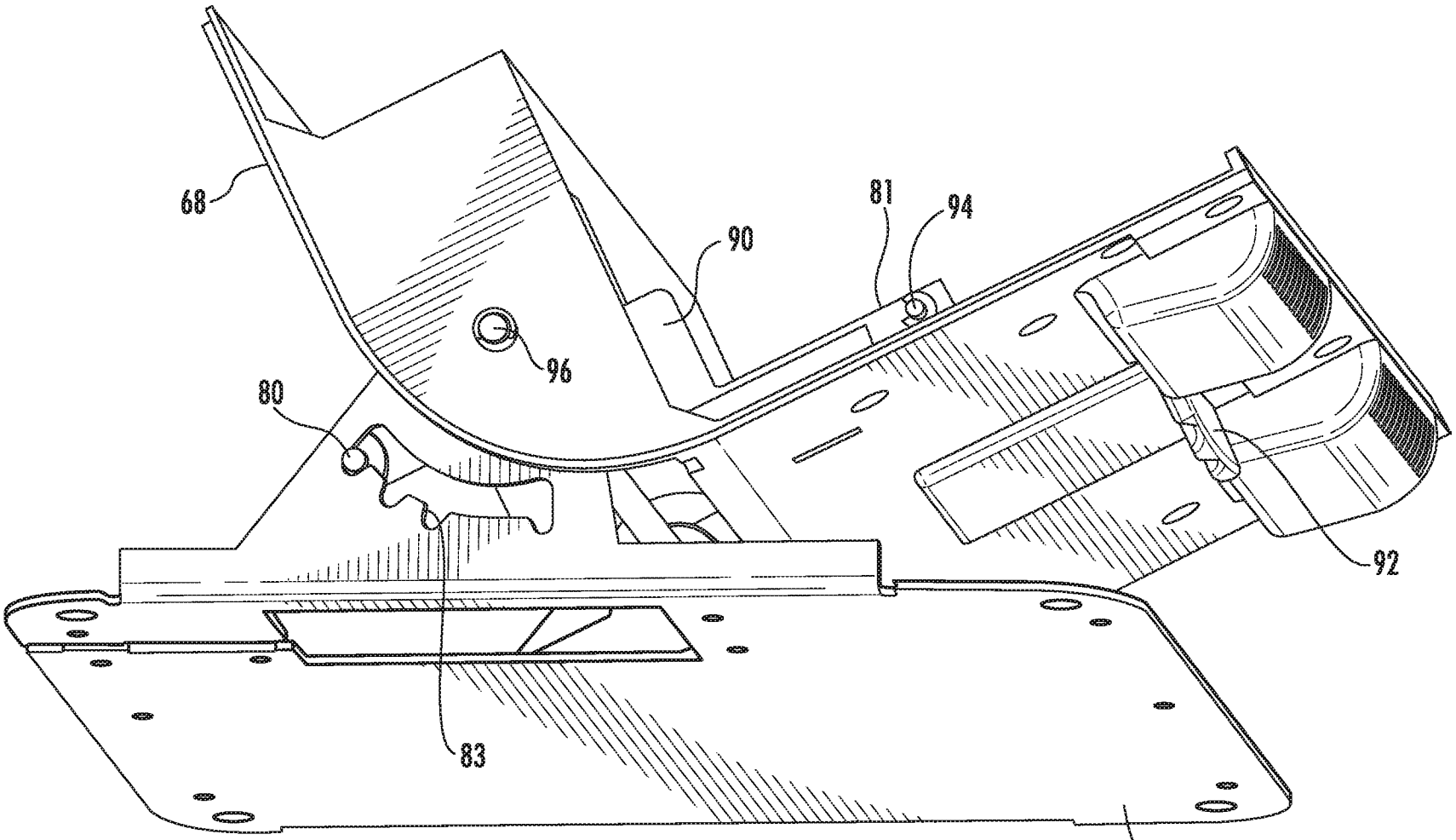

Further, the tolerances of the notches and the locking pins 80 are close tolerances which prohibit excess movement of the printer housing 68 with respect to the printer base 73 when the locking pins 80 are engaged with a corresponding notch. This in turn reduces or eliminates unwanted movement of the housing when a touch screen of the printer is being used. For example, an interference fit (or tolerances close thereto) between the notches and locking pins 80 can be provided. For example, the notches 82, 84, 86, and 88 may be substantially U-shaped notches. A radius at a bottom of each of the notches 82, 84, 86, and 88 may be smaller than a radius of the locking pin 80 (as can be seen in FIG. 16). Further, the sides 83 of each of the notches 82, 84, 86, and 88 may diverge from one another at a top open end of the notch. The larger top opening of the notch, together with a radius that is smaller than that of the locking pin, ensures that there are no clearances when the pivot mechanism comes to rest in a position defined by the locking pin 80 engaging with one of the notches.

Each locking pin 80 is connected to a corresponding lever arm 90. The lever arms 90 may extend through the printer base 73 and into an interior 65 of the housing 68 through slots 75 in the housing 68, as shown in FIG. 13. The lever arms 90 are positioned inside of the side walls 76. Each lever arm 90 is positioned adjacent a corresponding side wall 76. In addition, a portion 81 of each of the two lever arms 90 may slidably engage with guide ribs 85 disposed on an interior 65 of the printer housing 68. The guide ribs 85 may each comprise at least one raised feature which the portion 81 of the lever arm 90 slides upon. The guide ribs 85 reduce friction during movement of the pivot mechanism and contribute to reduced backlash in the system during use of the touch screen or upon other external pressure.

Figure 17:
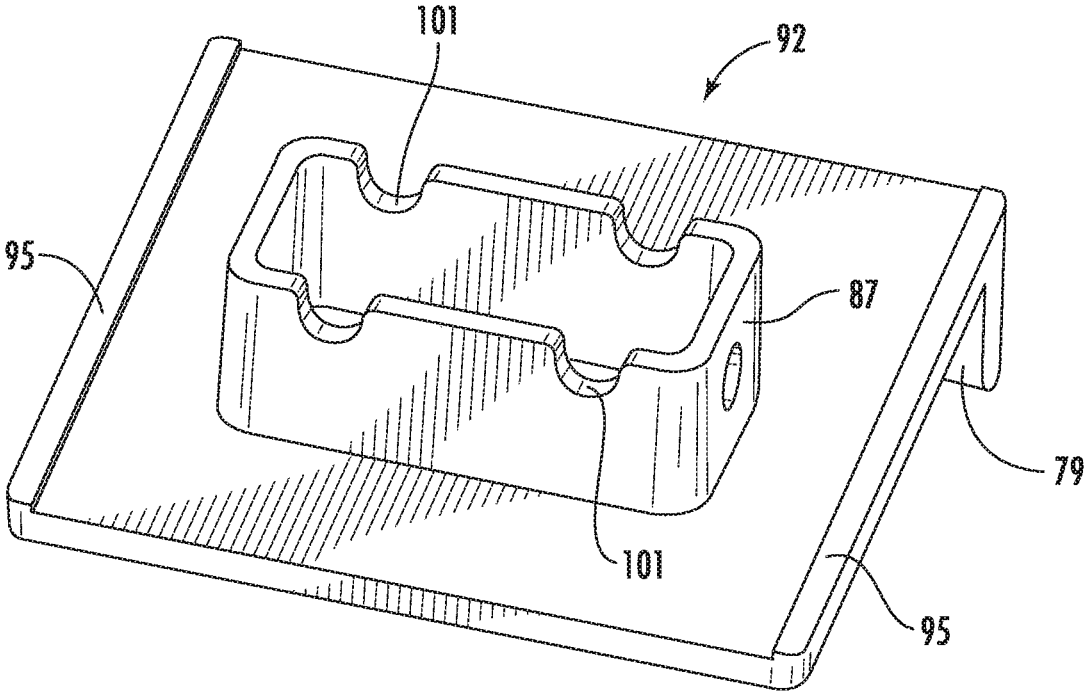

The lever arms 90 may be simultaneously actuated via a pull handle 92. The pull handle 92 is connected to each of the lever arms 90 via a connecting rod 94. The connecting rod is disposed in an interior of the printer housing 68. The printer housing 68 pivots on a pivot rod 96. The pivot rod 96 may extend either outside of or within an interior 65 of the printer housing 68 into or through opposing sides of the printer housing 68 (or extensions 69 of the sides of the printer housing 68). The pivot rod 96 may also extend through side walls of the printer base 73. Each of the lever arms 90 comprises an elongated slot 98 through which the pivot rod 96 passes. The pull handle 92 may be slidably disposed in a notch or opening 97 in a lower front portion of the printer housing 68 for connection to the connecting rod 94 in the interior 65 of the printer housing. For example, a first portion 87 of the pull handle 92 may extend into an interior 65 of the printer housing 68 through an opening 97 in the printer housing 68, and a second portion 79 of the pull handle 92 may extend over the opening 97 on an outside of the printer housing 68. As shown in FIG. 17, guide ribs 95 may be provided on an underside of the second portion 79 of the pull handle 92 which guide ribs 95 slidably engage against the outside of the printer housing 68. The guide ribs 95 serve to reduce friction and also contribute to reduced backlash in the system when pressure is exerted from the outside such as pressing on the touch screen or the printer housing.

A biasing mechanism 93 may be provided for biasing the locking pins 80 into one of the notches 82, 84, 86, or 88. The biasing mechanism may comprise, for example, one or more biasing springs 93 connected between the connecting rod 94 and an interior 65 of the housing 68, as shown in FIG. 13. Those skilled in the art will appreciate that other types of biasing means may be provided, such as elastic bands or the like. The biasing of the locking pins 80 into the notches also serves to remove unwanted movement of the housing when a touch screen of the printer is being used. For example, the biasing springs 93 may each provide a biasing force of approximately two pound-force.

Figure 14:
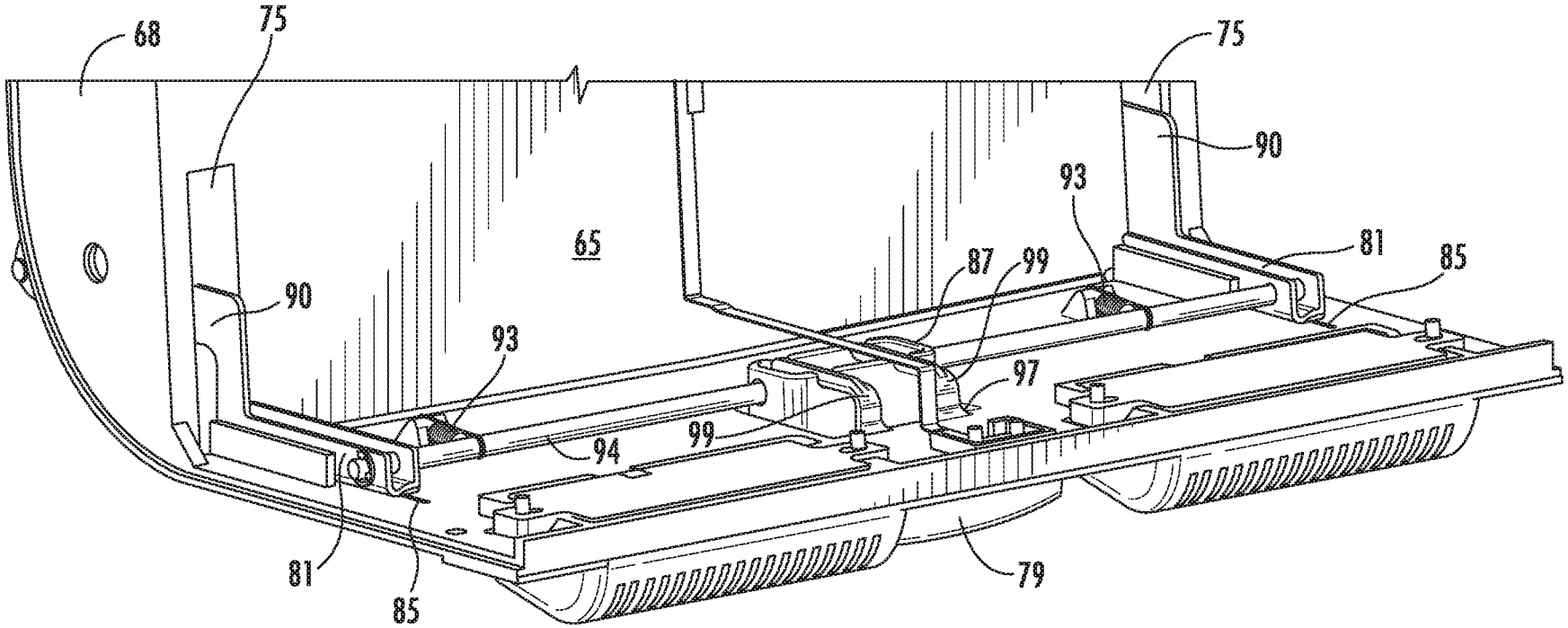
Figure 15:
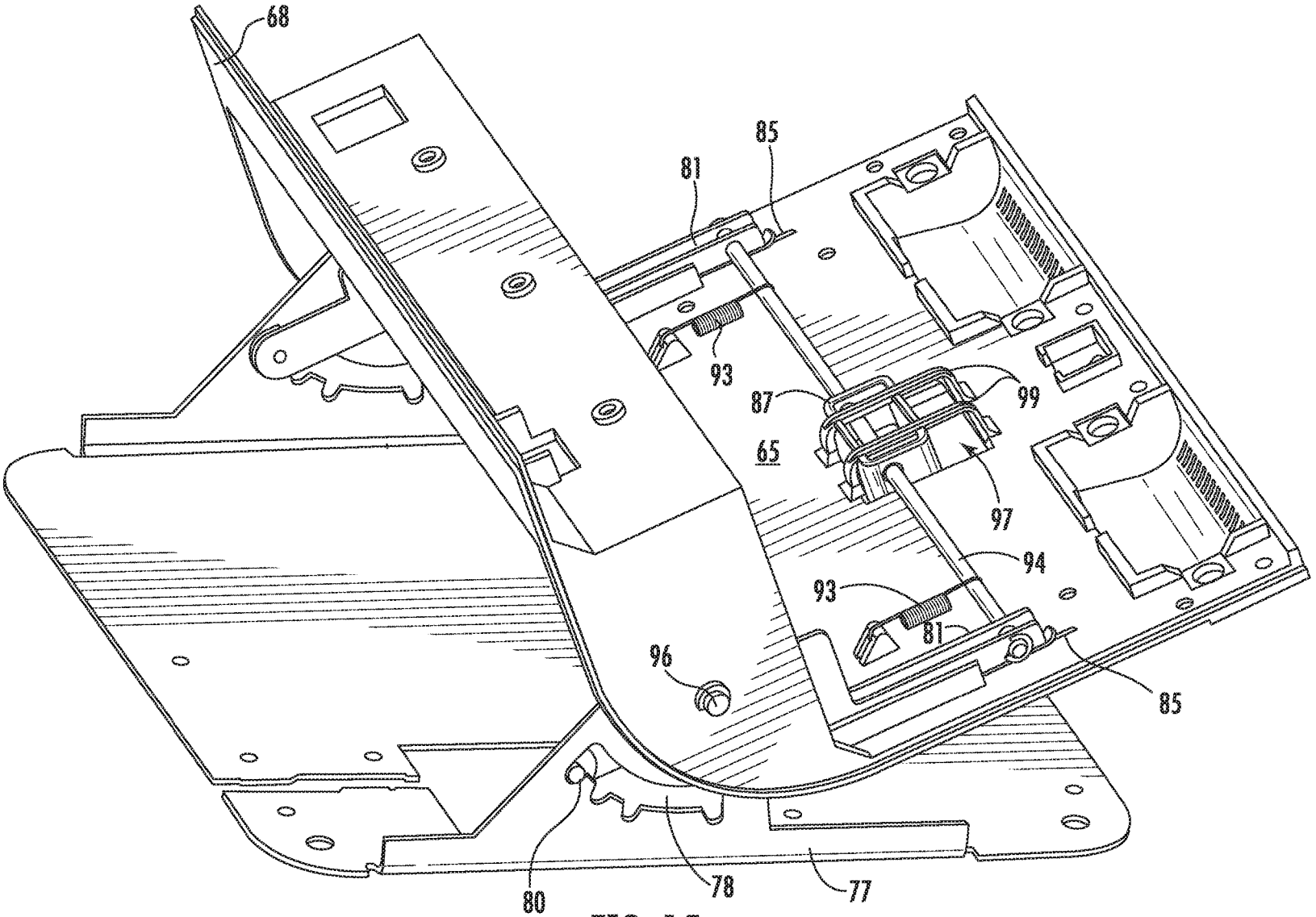

The connecting rod 94 may pass through the pull handle 92, exerting a first biasing force on the pull handle 92 in a direction towards the interior 65 of the printer housing 68. As shown in FIGS. 14 and 15, two straps 99 may be connected to the interior 65 of the printer housing 68 and pass over the first portion 87 of the pull handle 92. The two straps 99 may be arranged over the opening 97 in the interior 65 of the printer housing 98 and pass through and are guide by U-shaped openings 101 in the first portion 87 of the pull handle 92. The two straps 99 exert a second biasing force on the pull handle 92 in a direction away from the interior 65 of the printer housing 68 while permitting freedom of movement of the pull handle 92 in the opening 97 in a direction transverse to the first and second biasing forces. For example, the two straps may be U-shaped straps which span the opening 97 and are thus larger than the width of the first portion 87 of the pull handle 92. The first and second biasing forces serve to reduce backlash and to limit or remove unwanted movement of the printer housing during use of the touch screen.

The configuration and arrangement of the pull handle 92 (with the outer portion extending over the opening 97 and a smaller portion extending into the interior of the printer housing 68) and the connecting rod 94, together with the pivot rod 96 passing through the side walls of the printer housing and side walls 76 of the pivot mechanism, fixes the printer housing 68 with respect to the pivot mechanism 74, such that a pivoting movement of the pivot mechanism 74 results in a corresponding pivoting movement of the printer housing 68.

In operation, to adjust an angle of the printer housing 68, the pull handle 92 is pulled, engaging the lever arms 90, which results in removal of the locking pins 80 from their positions in one of the notches 82, 84, 86, or 88. The slots 98 permit the lever arms 90 freedom of movement to disengage and reengage the locking pins 80 from the notches 82, 84, 86, or 88, while at the same time guiding the pivoting motion about the pivot rod 96. Once the locking pins 80 are disengaged from the corresponding notch (82, 84, 86 or 88), the printer housing 68 can be pivoted about the pivot rod 96 into a desired position, at which time the pull handle 92 can be released. Upon release of the pull handle 92, the biasing force of the biasing spring(s) 93 urges the locking pins 80 into a notch corresponding to the desired position, upon alignment of the locking pins 80 and the corresponding notches.

The present invention also encompasses a printer with a pivoting printer housing, comprising a printer housing 68, a printer base 73, and a pivot mechanism 74 which pivotally connects the printer housing 68 to the printer base 73. The pivot mechanism 74 may include the features as described above in connection with FIGS. 11-13.

The pivot mechanism 74 may enable the printer housing to be fixed in different predetermined angles for viewing the display screen located in the printer housing, or to pivot the printer housing to facilitate paper loading or removal, and/or to facilitate access to an interior of the printer housing 68 (e.g., by tilting the printer housing 68 into position to open a cover or otherwise provide access to internal printer mechanisms and electronics).

The present invention also encompasses a support for supporting a paper roll in a paper bucket of a printer. The support for supporting a paper roll may comprise a two-part spring-loaded spindle assembly 16 extending through each of two oppositely disposed side walls 14 of a paper bucket 10 and adapted to support a paper roll therebetween, as discussed above.

The present invention also encompasses a printer 70 with a paper bucket 10 as discussed above.

In addition, the present invention also encompasses a method for providing a paper bucket 10 for a printer 70. An example embodiment of such a method may comprise providing a curved base portion 12 for accepting paper rolls of varying widths, movably mounting two oppositely disposed side walls 14 to the curved base portion 12, and providing a two-part spring-loaded spindle assembly 16 which extends through each of the side walls and which is adapted to support a paper roll therebetween, as discussed above.

Corresponding methods for providing a support for a paper roll and a printer are also encompassed by the present invention.

The support, the printer, and the methods may also include additional features of the various embodiments of the paper bucket discussed above and set forth in the Figures.

It should now be appreciated that the present invention provides advantageous apparatus for pivotal mounting of a printer housing.

Although the invention has been described in connection with various illustrated embodiments, numerous modifications and adaptations may be made thereto without departing from the spirit and scope of the invention as set forth in the claims.

What is claimed is:

1. A pivot mechanism for a printer, comprising:

a pivot base;

two oppositely disposed side walls extending perpendicular to the pivot base;

an arched slot provided in each of the side walls, each slot having at least two notches, each of the at least two notches defining different positions of the pivot mechanism;

two lever arms, each of the two lever arms comprising a first end and a second end;

a connecting rod connecting the first ends of the lever arms together;

a locking pin disposed on the second end of each of the lever arms, each of the locking pins extending into a corresponding one of the slots and engaging with a corresponding one of the at least two notches; and a pivot rod extending through the lever arms and into or through the side walls;

wherein a printer housing of the printer is adapted to pivot on the pivot rod.

2. A pivot mechanism in accordance with claim 1, wherein the at least two notches locate the printer housing at predetermined angles in order to provide for at least one of adjustability of a viewing angle of a screen located in the printer housing, paper loading and removal, and opening of a printer housing cover for access to an interior of the printer housing.

3. A pivot mechanism in accordance with claim 1, wherein the lever arms are positioned inside of the side walls and each of the lever arms is positioned adjacent a corresponding one of the side walls.

4. A pivot mechanism in accordance with claim 1, wherein the pivot rod extends through elongated slots in the lever arms.

5. A pivot mechanism in accordance with claim 1, further comprising a pull handle connected to the connecting rod for disengaging the locking pins from the corresponding notches, enabling a pivoting motion about the pivot rod.

6. A pivot mechanism in accordance with claim 5, wherein:

the pivot rod extends through elongated slots in the lever arms; and the slots are adapted to permit the lever arms freedom of movement relative to the pivot rod to allow the pull handle to move the lever arms in order to disengage the locking pins from the corresponding notches while guiding the pivoting motion.

7. A pivot mechanism in accordance with claim 6, wherein:

the lever arms extend into an interior of the printer housing through slots in the printer housing;

the connecting rod is disposed in the interior of the printer housing; and the pull handle is slidably disposed in a front of the printer housing with a first portion of the pull handle extending into the interior of the printer housing through an opening in the printer housing and a second portion of the pull handle extending over the opening on an outside of the printer housing, the first portion of the pull handle being connected to the connecting rod.

8. A pivot mechanism in accordance with claim 7, further comprising guide ribs arranged on an underside of the second portion of the pull handle which guide ribs slidably engage against the outside of the printer housing.

9. A pivot mechanism in accordance with claim 7, wherein the connecting rod passes through the pull handle, exerting a first biasing force on the pull handle in a direction towards the interior of the printer housing.

10. A pivot mechanism in accordance with claim 9, further comprising two straps connected to the interior of the printer housing and passing over the first portion of the pull handle, the two straps exerting a second biasing force on the pull handle in a direction away from the interior of the printer housing while permitting freedom of movement of the pull handle in a direction transverse to the first and second biasing forces.

11. A pivot mechanism in accordance with claim 5, further comprising a biasing mechanism for biasing the locking pins into the corresponding notches upon a release of the pull handle.

12. A pivot mechanism in accordance with claim 11, wherein the biasing mechanism may comprise at least one biasing spring connected between the connecting rod and the printer housing.

13. A pivot mechanism in accordance with claim 1, wherein:

the slot is arranged off center in relation to a line passing through an axis of the pivot rod perpendicular to the pivot base; and the line does not pass through any of the at least two notches.

14. A pivot mechanism in accordance with claim 1, wherein the at least two notches are substantially U-shaped notches.

15. A pivot mechanism in accordance with claim 14, wherein:

a radius at a bottom of each of the at least two notches is smaller than a radius of the locking pin; and sides of each of the at least two notches diverge from one another at a top open end of the notch.

16. A pivot mechanism in accordance with claim 1, wherein a portion of each of the two lever arms slidably engages with at least one guide rib disposed on an interior of the printer housing.

17. A pivot mechanism in accordance with claim 1, wherein the at least two notches comprises a first notch, a second notch, a third notch, and a fourth notch.

18. A pivot mechanism in accordance with claim 17, wherein:

the first, second, and third notches provide different viewing angles for the printer housing in a table mounting position; and the fourth notch is spaced apart from the first, second, and third notches and provides a viewing angle for the printer housing in a wall mounting position.

19. A pivot mechanism in accordance with claim 1, wherein:

at least one of the at least two notches defines a table mounting position for the printer housing; and at least one other of the at least two notches defines a wall mounting position for the printer housing.

20. A pivot mechanism in accordance with claim 1, wherein:

the pivot base is adapted to be mounted to an underside of a printer base for the printer; and the lever arms extend through slots in the printer base.

21. A pivot mechanism in accordance with claim 1, wherein the pivot rod further extends into or through side walls of the printer base and side walls of the printer housing.

22. A printer with a pivoting printer housing, comprising:

a printer housing;

a printer base; and a pivot mechanism pivotally connecting the printer housing to the printer base, the pivot mechanism comprising:

a pivot base connected to the printer base;

two oppositely disposed side walls extending perpendicular to the pivot base;

an arched slot provided in each of the side walls, each slot having at least two notches, each of the at least two notches defining different positions of the pivot mechanism;

two lever arms, each of the two lever arms comprising a first end and a second end;

a connecting rod connecting the first ends of the lever arms together;

a locking pin disposed on the second end of each of the lever arms, each of the locking pins extending into a corresponding one of the slots and engaging with a corresponding one of the at least two notches; and a pivot rod extending through the lever arms and into or through the side walls of the pivot base;

wherein the printer housing is adapted to pivot on the pivot rod.

23. A printer in accordance with claim 22, wherein the at least two notches locate the printer housing at predetermined angles in order to provide for at least one of adjustability of a viewing angle of a screen located in the printer housing, paper loading and removal, and opening of a printer housing cover for access to an interior of the printer housing.

24. A printer in accordance with claim 22, wherein the lever arms are positioned inside of the side walls and each of the lever arms is positioned adjacent a corresponding one of the side walls.

25. A printer in accordance with claim 22, wherein the pivot rod extends through elongated slots in the lever arms.

26. A printer in accordance with claim 22, wherein the pivot mechanism further comprises a pull handle connected to the connecting rod for disengaging the locking pins from the corresponding notches, enabling a pivoting motion about the pivot rod.

27. A printer in accordance with claim 26, wherein:

the pivot rod extends through elongated slots in the lever arms; and the slots are adapted to permit the lever arms freedom of movement relative to the pivot rod to allow the pull handle to move the lever arms in order to disengage the locking pins from the corresponding notches while guiding the pivoting motion.

28. A printer in accordance with claim 27, wherein:

the lever arms extend into an interior of the printer housing through slots in the printer housing;

the connecting rod is disposed in the interior of the printer housing; and the pull handle is slidably disposed in a front of the printer housing with a first portion of the pull handle extending into the interior of the printer housing through an opening in the printer housing and a second portion of the pull handle extending over the opening on an outside of the printer housing, the first portion of the pull handle being connected to the connecting rod.

29. A printer in accordance with claim 28, wherein the pivot mechanism further comprises guide ribs arranged on an underside of the second portion of the pull handle which guide ribs slidably engage against the outside of the printer housing.

30. A printer in accordance with claim 28, wherein the connecting rod passes through the pull handle, exerting a first biasing force on the pull handle in a direction towards the interior of the printer housing.

31. A printer in accordance with claim 30, further comprising two straps connected to the interior of the printer housing and passing over the first portion of the pull handle, the two straps exerting a second biasing force on the pull handle in a direction away from the interior of the printer housing while permitting freedom of movement of the pull handle in a direction transverse to the first and second biasing forces.

32. A printer in accordance with claim 26, wherein the pivot mechanism further comprises a biasing mechanism for biasing the locking pins into the corresponding notches upon a release of the pull handle.

33. A printer in accordance with claim 32, wherein the biasing mechanism may comprise at least one biasing spring connected between the connecting rod and the printer housing.

34. A printer in accordance with claim 22, wherein:

the slot is arranged off center in relation to a line passing through an axis of the pivot rod perpendicular to the pivot base; and the line does not pass through any of the at least two notches.

35. A printer in accordance with claim 22, wherein the at least two notches are substantially U-shaped notches.

36. A printer in accordance with claim 35, wherein:

a radius at a bottom of each of the at least two notches is smaller than a radius of the locking pin; and sides of each of the at least two notches diverge from one another at a top open end of the notch.

37. A printer in accordance with claim 22, wherein a portion of each of the two lever arms slidably engages with at least one guide rib disposed on an interior of the printer housing.

38. A printer in accordance with claim 22, wherein the at least two notches comprises a first notch, a second notch, a third notch, and a fourth notch.

39. A printer in accordance with claim 38, wherein:

the first, second, and third notches provide different viewing angles for the printer housing in a table mounting position; and the fourth notch is spaced apart from the first, second, and third notches and provides a viewing angle for the printer housing in a wall mounting position.

40. A printer in accordance with claim 22, wherein:

at least one of the at least two notches defines a table mounting position for the printer housing; and at least one other of the at least two notches defines a wall mounting position for the printer housing.

41. A printer in accordance with claim 22, wherein:

the lever arms extend through slots in the printer base.

42. A printer in accordance with claim 22, wherein the pivot rod further extends into or through side walls of the printer base and side walls of the printer housing.

* * * * *